US010968147B2

(12) United States Patent
Bley et al.

(10) Patent No.: US 10,968,147 B2
(45) Date of Patent: Apr. 6, 2021

(54) PYROTECHNIC AGENT

(75) Inventors: Ulrich Bley, Furth (DE); Rainer Hagel, Erlangen (DE); Julia Havlik, Furth (DE); Aleksej Hoschenko, Furth (DE); Peter Simon Lechner, Oberasbach (DE)

(73) Assignee: RUAG AMMOTEC GMBH, Furth (DE)

( * ) Notice: Subject to any disclaimer, the term of this patent is extended or adjusted under 35 U.S.C. 154(b) by 1940 days.

(21) Appl. No.: 11/916,346

(22) PCT Filed: Jun. 2, 2006

(86) PCT No.: PCT/EP2006/062862

§ 371 (c)(1),
(2), (4) Date: Dec. 5, 2008

(87) PCT Pub. No.: WO2006/128910

PCT Pub. Date: Dec. 7, 2006

(65) Prior Publication Data

US 2009/0133787 A1 May 28, 2009

(30) Foreign Application Priority Data

Jun. 2, 2005 (DE) ..... 10 2005 025 746.1
Mar. 22, 2006 (DE) ..... 10 2006 013 622.5

(51) Int. Cl.
*C06C 9/00* (2006.01)
*C06D 5/06* (2006.01)

(52) U.S. Cl.
CPC . *C06C 9/00* (2013.01); *C06D 5/06* (2013.01)

(58) Field of Classification Search
CPC ..... C06C 9/00; C06D 5/06
See application file for complete search history.

(56) References Cited

U.S. PATENT DOCUMENTS

| | | | | |
|---|---|---|---|---|
| 3,719,604 | A | 3/1973 | Prior et al. | |
| 5,198,046 | A | 3/1993 | Bucerius et al. | |
| 5,663,524 | A | 9/1997 | Bucerius et al. | |
| 5,877,300 | A * | 3/1999 | Peng et al. | 534/765 |
| 5,962,808 | A * | 10/1999 | Lundstrom | 149/19.1 |
| 6,007,647 | A | 12/1999 | Burns et al. | |
| 6,620,266 | B1 * | 9/2003 | Williams et al. | 149/3 |
| 2004/0231767 | A1 * | 11/2004 | Mendenhall et al. | 149/19.2 |

FOREIGN PATENT DOCUMENTS

| | | |
|---|---|---|
| DE | 34 22 433 | 7/1987 |
| DE | 40 34 645 | 5/1992 |
| JP | 2000-506111 A | 5/2000 |
| JP | 2004-007920 | 1/2004 |
| WO | WO 97/29927 | 8/1997 |
| WO | WO 2005/035312 A2 | 4/2005 |

* cited by examiner

*Primary Examiner* — Aileen B Felton
(74) *Attorney, Agent, or Firm* — Fitch, Even, Tabin & Flannery, LLP

(57) ABSTRACT

The invention relates to a pyrotechnic agent containing at least one azotetrazolate as a component thereof.

15 Claims, No Drawings

PYROTECHNIC AGENT

The present invention relates to a pyrotechnic agent.

Pyrotechnic agents within the meaning of the invention are substances or mixtures of substances that can produce a pyrotechnic effect.

In particular the present invention provides a pyrotechnic agent that can be used as a thermal early-ignition agent.

Areas of application of such thermal early-ignition agents are for example safety systems, preferably thermal safety fuses in gas generators or separators for batteries. Such safety systems are in turn preferably used in vehicles.

Thermal early-ignition agents are pyrotechnic substances or mixtures that inter alia have the task of igniting in a controlled manner the mixtures of the gas generator, which as a rule produce thermally very stable gas, in the event of a vehicle fire.

Another example of application of thermal early-ignition agents is their use as a pyrotechnic charge in separators, preferably for battery terminals. These separators are designed to interrupt the power supply in the event of a fire, in particular a vehicle fire, or in the event of a vehicle accident, in which the gas generator is triggered.

As thermal early-ignition agents there are used for example nitrocellulose, propellant charge powders derived therefrom, or the mixtures based on nitrotriazolone and guanidine nitrate, described in patent application DE 197 30 873 A1. These mixtures have ignition temperatures of ca. 160° C., and in the case of nitrocellulose have inadequate long-term storage stability.

The object of the present invention was to provide a pyrotechnic agent with an ignition temperature of around 180° C. and with satisfactory long-term storage stability. A further object of the present invention was to provide a pyrotechnic agent that can be used as a thermal early-ignition agent for gas generators in vehicle safety systems. Yet a further object of the present invention was to provide a pyrotechnic agent that can be used in separators for battery terminals.

According to the invention this object is surprisingly achieved by the features of the main claim. Preferred embodiments are disclosed in the sub-claims. In this connection, according to the invention azotetrazolates are used as components. In particular aminoguanidine-5,5'-azotetrazolate ($C_4H_{14}N_{18}$), abbreviated to AGATZ, and guanidine-5,5'-azotetrazolate ($C_4H_{12}N_{16}$), abbreviated to GATZ, are used as azotetrazolate component.

The azotetrazolate component can be used either alone or in mixtures with one another and/or with further components. The structural formulae of AGATZ and GATZ are as follows:

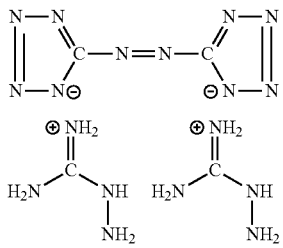

Aminoguanidine-5,5'-azotetrazolate ($C_4H_{14}N_{18}$, AGATZ)

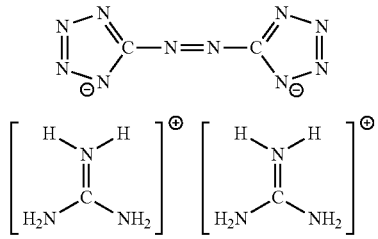

Guanidine-5,5'-azotetrazolate ($C_4H_{12}N_{16}$, GATZ)

The deflagration temperature of pure AGATZ is 209° C., and of GATZ is 240° C.

It was surprisingly found that with mixtures of AGATZ and/or GATZ and/or selected components, the deflagration temperatures can be controlled in the range from 165° C. to 195° C. and the deflagration temperatures of the mixture may be lower than those of the individual components.

For early-ignition agents deflagration temperatures below 200° C. are particularly useful. The pyrotechnic agents according to the invention meet this requirement, and have excellent long-term storage stability.

The following can be used as additives:

1. Oxidising agents (individually or in mixtures)
   Nitrates of the alkali or alkaline-earth metals or of ammonium, such as sodium, potassium or ammonium nitrate, perchlorates of the alkali or alkaline-earth metals or of ammonium, peroxides of the alkali or alkaline-earth metals or of zinc.
2. Nitrogen-containing compounds (individually or in mixtures)
   Ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole such as 5-aminotetrazole, ditetrazolylamine, ditetrazole and its salts, nitraminotetrazole and its salts such as ammonium nitraminotetrazolate and aminoguanidinium nitraminotetrazolate, aminoguanidine nitrate, diaminoguanidine nitrate, triaminoguanidine nitrate, guanidine nitrate, dicyandiamidine nitrate, diaminoguanidine azotetrazolate, triaminoguanidine azotetrazolate or ammonium azotetrazolate.
3. Energy-rich additives (individually or in mixtures)
   Hexogen, octogen, nitrocellulose.
4. Reducing agents (individually or in mixtures)
   Aluminium, titanium, titanium hydride, boron, boron hydride, zirconium, zirconium hydride, silicon, graphite, activated charcoal, carbon black.
5. Binders (individually or in mixtures)
   Cellulose as well as its derivatives, polyvinylbutyrals, polynitropolyphenylene, polynitrophenyl ether, plexigum, polyvinyl acetate, copolymers.
6. Combustion moderators, stabilisers and processing aids (individually or in mixtures)
   Ferrocene and derivatives, acetonylacetates, salicylates, barium carbonate, strontium carbonate, magnesium carbonate, melamine, zinc oxide, zinc carbonate, silicates, silica gels, silicic acids, for example Aerosil (Degussa Company), boron nitride.

The production and processing is carried out according to conventional processes known per se. These include for example kneading, extrusion, extrusion moulding, tabletting or granulation.

The present invention provides in particular:

a pyrotechnic agent, which contains as component one or more azotetrazolates;

a pyrotechnic agent, wherein the azotetrazolate component is selected from aminoguanidine-5,5'-azotetrazolate (AGATZ) and guanidine-5,5'-azotetrazolate (GATZ) or mixtures of the two;

a pyrotechnic agent, wherein the amount of the azotetrazolate component is 100 wt. %;

a pyrotechnic agent, wherein the amount of the azotetrazolate component is 10 to 99 wt. %, preferably 15 to 60 wt. %, particularly preferably 20 to 50 wt. %;

a pyrotechnic agent that contains 1 to 90 wt. %, preferably 40 to 85 wt. %, particularly preferably 50 to 80 wt. %, of an additive or mixtures of several additives;

a pyrotechnic agent, wherein the additives are selected from: ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole and/or its salts, nitraminotetrazole and/or its salts, aminoguanidine nitrate, diaminoguanidine nitrate, triaminoguanidine nitrate, guanidine nitrate, dicyandiamidine nitrate, diaminoguanidine azotetrazolate, triaminoguanidine azotetrazolate, ammonium azotetrazolate; nitrates of alkali and/or alkaline-earth metals and/or of ammonium, perchlorates of alkali and/or alkaline-earth metals and/or of ammonium, peroxides of alkali and/or alkaline-earth metals and/or of zinc; aluminium, titanium, titanium hydride, boron, boron hydride, zirconium, zirconium hydride, silicon, graphite, activated charcoal, carbon black; cellulose and/or its derivatives, polyvinylbutyrals, polynitropolyphenylene, polynitrophenyl ether, plexigum, polyvinyl acetate and copolymers; hexogen, octogen; ferrocene and/or its derivatives, acetonylacetates, salicylates, barium carbonate, strontium carbonate, magnesium carbonate, melamine, zinc oxide, zinc carbonate, silicates, silica gels, silicic acids, for example Aerosil (Degussa Company), boron nitride;

a pyrotechnic agent that contains 10 to 90 wt. %, preferably 20 to 70 wt. %, particularly preferably 30 to 60 wt. % of an oxidising agent;

a pyrotechnic agent, wherein the oxidising agent is selected from one or more nitrates of alkali and/or alkaline-earth metals and/or of ammonium, perchlorates of alkali and/or alkaline-earth metals and/or of ammonium, peroxides of alkali and/or alkaline-earth metals and/or of zinc;

a pyrotechnic agent that contains 10 to 90 wt. %, preferably 10 to 60 wt. %, particularly preferably 15 to 40 wt. % of a nitrogen-containing compound;

a pyrotechnic agent, wherein the nitrogen-containing compound is selected from one or more of ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole and/or its salts, nitraminotetrazole and/or its salts, aminoguanidine nitrate, diaminoguanidine nitrate, triaminoguanidine nitrate, guanidine nitrate, dicyandiamidine nitrate, diaminoguanidine azotetrazolate, triaminoguanidine azotetrazolate, ammonium azotetrazolate;

a pyrotechnic agent that contains 1 to 90 wt. %, preferably 1 to 60 wt. %, particularly preferably 1 to 40 wt. % of high-energy additives;

a pyrotechnic agent, wherein the high-energy additives are selected from one or more of hexogen, octogen and/or nitrocellulose;

a pyrotechnic agent that contains 1 to 80 wt. %, preferably 1 to 40 wt. %, particularly preferably 1 to 15 wt. % of a reducing agent;

a pyrotechnic agent, wherein the reducing agent is selected from one or more of aluminium, titanium, titanium hydride, boron, boron hydride, zirconium, zirconium hydride, silicon, graphite, activated charcoal, carbon black;

a pyrotechnic agent that contains 1 to 80 wt. %, preferably 1 to 40 wt. %, particularly preferably 1 to 20 wt. % of a binder;

a pyrotechnic agent, wherein the binder is selected from one or more of cellulose and its derivatives, polyvinylbutyrals, polynitropolyphenylene, polynitrophenyl ether, plexigum, polyvinyl acetate and copolymers;

a pyrotechnic agent that contains 0.1 to 20 wt. %, preferably 0.1 to 15 wt. %, particularly preferably 1 to 10 wt. % of combustion moderators, stabilisers and processing aids;

a pyrotechnic agent, wherein the combustion moderators and processing aids are selected from one or more of ferrocene and its derivatives, acetonylacetates, salicylates, barium carbonate, strontium carbonate, magnesium carbonate, melamine, zinc oxide, zinc carbonate, silicates, silica gels, silicic acids, for example Aerosil (Degussa Company), and/or boron nitride;

use of the pyrotechnic agent according to the invention as a thermal early-ignition agent;

use of the pyrotechnic agent according to the invention as a thermal safety fuse;

use of the pyrotechnic agent according to the invention in vehicle safety systems;

use of the pyrotechnic agent according to the invention in gas generators;

use of the pyrotechnic agent according to the invention in separators, preferably for battery terminals.

The invention is described in more detail by means of the following examples, without however being restricted thereto:

The compositions of 27 different mixtures of the pyrotechnic agent are listed in Table 1. The components were weighed out in the specified amounts (amounts refer to weight percent) into plastics containers and homogenised for 30 minutes in a tumble mixer.

TABLE 1

| Mixtures | | | | | | | |
|---|---|---|---|---|---|---|---|
| Mixture | AGATZ (GATZ) | Hexogen | Octogen | Amino-guanidinium picrate | Others | Sodium nitrate | Potassium nitrate |
| 1 | 30 | 20 | | | | 50 | |
| 2 | 30 | | 20 | | | 50 | |

TABLE 1-continued

| Mixtures | | | | | | | |
|---|---|---|---|---|---|---|---|
| Mixture | AGATZ (GATZ) | Hexogen | Octogen | Amino-guanidinium picrate | Others | Sodium nitrate | Potassium nitrate |
| 3 | 30 | | | 30 | | | 40 |
| 4 | 30 | 10 | | 20 | | 40 | |
| 5 | 30 | | 10 | 20 | | 40 | |
| 6 | 30 | | 10 | | AGSt: 20 | 40 | |
| 7 | 30 | | 10 | 20 | | | 40 |
| 8 | 30 | | | 10 | AGSt: 20 | 40 | |
| 9 | 30 | | | | GPik: 10<br>AGSt: 20 | 40 | |
| 10 | 30 | | | | GPik: 30 | 40 | |
| 11 | 30 | | | 20 | AGSt: 10 | | 40 |
| 12 | 30 | | | 30 | | 40 | |
| 13 | | | 30 | 30 | | | 40 |
| 14 | | 30 | | 30 | | 40 | |
| 15 | 30 | | | | AGSt: 30 | 40 | |
| 16 | 30 | | | 10 | GPik: 20 | 40 | |
| 17 | 30 | | | 10 | Nigu: 20 | 40 | |
| 18 | 30 | | | | AGSt: 30 | | 40 |
| 19 | 30 | | | 10 | GSt: 20 | | 40 |
| 20 | GATZ: 30 | | | | AGSt: 30 | | 40 |
| 21 | GATZ: 30 | | | 30 | | | 40 |
| 22 | GATZ: 30 | | | 10 | AGSt: 20 | | 40 |
| 23 | 30 | | | | AGSt: 10<br>APik: 20 | | 40 |
| 24 | 30 | | | 20 | APik: 10 | | 40 |
| 25 | 30 | | | | APik: 30 | | 40 |
| 26 | 30 | 10 | | | GPik: 20 | | 40 |
| 27 | 30 | | 10 | | GPik: 20 | | 40 |

AGSt: Aminoguanidinium styphnate
GPik: Guanidinium picrate
Nigu: Nitroguanidine
APik: Ammonium picrate The deflagration temperatures and friction and impact sensitivities of the mixtures are given in Table 2. The friction and impact sensitivities were measured according to the methods of the Bundesanstalt für Materialforschung (BAM) (Federal Institute for Materials Testing), while the deflagration temperatures were measured by thermo-gravimetric analysis (Mettler Company) at a heating rate of 10° C. per minute.

TABLE 2

| Summary of the deflagration temperatures and friction and impact sensitivities | | | |
|---|---|---|---|
| Mixture | Deflagration temperature [° C.] | Friction sensitivity [N] | Impact sensitivity [J] |
| 1 | 180 | 240 | 3 |
| 2 | 190 | 240 | 3 |
| 3 | 182 | >360 | 4 |
| 4 | 165 | 240 | 3 |
| 5 | 172 | 360 | 2 |
| 6 | 190 | >360 | 2 |
| 7 | 172 | >360 | 2 |
| 8 | 172 | >360 | 4 |
| 9 | 181 | >360 | 5 |
| 10 | 192 | >360 | 8 |
| 11 | 178 | >360 | 6 |
| 12 | 182 | >360 | 4 |
| 13 | 221 | 360 | 2 |
| 14 | 217 | 240 | 3 |
| 15 | 172 | >360 | 6 |
| 16 | 192 | >360 | 5 |
| 17 | 191 | >360 | 6 |
| 18 | 174 | >360 | 6 |
| 19 | 182 | >360 | 10 |
| 20 | 181 | >360 | 8 |

TABLE 2-continued

| Summary of the deflagration temperatures and friction and impact sensitivities | | | |
|---|---|---|---|
| Mixture | Deflagration temperature [° C.] | Friction sensitivity [N] | Impact sensitivity [J] |
| 21 | 195 | >360 | 10 |
| 22 | 180 | >360 | 4 |
| 23 | 180 | >360 | 5 |
| 24 | 180 | >360 | 4 |
| 25 | 175 | >360 | 3 |
| 26 | 175 | >360 | 2 |
| 27 | 180 | >360 | 3 |

The weight losses and deflagration temperatures after thermal loading (24 hours, 125° C. and 400 hours, 110° C.) of some of the mixtures chosen from the examples are summarised in Table 3. The measurement of the weight loss was carried out in a similar way to the Holland Test. The deflagration temperatures were measured by thermo-gravimetric analysis (Mettler Company) at a heating rate of 10° C. per minute.

After 400 hours only slight weight losses of 0.1 to 0.7 wt. % are detected, and there are no significant changes in the deflagration temperature after thermal loading.

TABLE 3

Summary of the weight losses and deflagration temperatures

| Mixture | Weight loss 24 h, 125° C. [wt. %] | Weight loss 400 h, 110° C. [wt. %] | Deflagration temp, after 24 h, 125° C. [° C.] | Deflagration temp, after 400 h, 110° C. [° C.] |
|---|---|---|---|---|
| 5 | 0.34 | 0.7 | 172 | 178 |
| 12 | 0.03 | 0.1 | 182 | 191 |
| 26 | 2.11 | 0.7 | 175 | 175 |
| 27 | 0.36 | 0.2 | 180 | 186 |

These results show that the specific pyrotechnic agents according to the invention have deflagration temperatures in the range from 172° to 191° C. and should be regarded as stable according to the requirements of the automobile industry.

In addition the following mixtures have proved to be particularly advantageous, in particular also for use in separators for battery terminals:

30 wt. % aminoguanidine-5,5'-azotetrazolate, 27.5 wt. % guanidinium picrate, 40 wt. % sodium nitrate, 2 wt. % titanium and 0.5 wt. % graphite;

29 wt. % aminoguanidine-5,5'-azotetrazolate, 29 wt. % guanidinium picrate, 40 wt. % sodium nitrate, 1.5 wt. % barium carbonate and 0.5 wt. % Aerosil;

24 wt. % aminoguanidine-5,5'-azotetrazolate, 24 wt. % guanidinium picrate, 50 wt. % sodium nitrate, 1.5 wt. % barium carbonate and 0.5 wt. % Aerosil;

29 wt. % aminoguanidine-5,5'-azotetrazolate, 29 wt. % guanidinium picrate, 40 wt. % sodium nitrate, 1.5 wt. % strontium carbonate and 0.5 wt. % Aerosil.

The invention claimed is:

1. A pyrotechnic consisting of 20 to 50 wt. % of at least one azotetrazolate component selected from the group consisting of aminoguanidine-5,5'-azotetrazolate (AGATZ) and guanidine-5,5'-azotetrazolate (GATZ), and 50 to 80 wt. % of at least one additive selected from the group consisting of ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole and/or its salts, nitraminotetrazole and/or its salts, aminoguanidine nitrate, diaminoguanidine nitrate, triaminoguanidine nitrate, guanidine nitrate, dicyandiamidine nitrate, diaminoguanidine azotetrazolate, nitrates of alkali and/or alkaline-earth metals and/or of ammonium, perchlorates of alkali and/or alkaline-earth metals and/or of ammonium, peroxides of alkali and/or alkaline-earth metals and/or of zinc, aluminium, titanium, titanium hydride, boron, boron hydride, zirconium, zirconium hydride, silicon, graphite, activated charcoal, carbon black, cellulose and/or its derivatives, polyvinylbutyrals, polynitropolyphenylene, polynitrophenyl ether, plexigum, polyvinyl acetate and copolymers, hexogen, octogen, nitrocellulose, ferrocene and/or its derivatives, acetonylacetates, salicylates, carbonates, melamine, silicates, silica gels, and boron nitride, wherein a deflagration temperature of the pyrotechnic agent in a range from 165° C. to 195° C.

2. The pyrotechnic agent according to claim 1, comprising 30 to 60 wt. % of at least one oxidising agent selected from the group consisting of nitrates of alkali and/or alkaline-earth metals and/or of ammonium, perchlorates of alkali and/or alkaline-earth metals and/or of ammonium, and peroxides of alkali and/or alkaline-earth metals and/or of zinc.

3. The pyrotechnic agent according to claim 1, comprising 15 to 40 wt. % of at least one nitrogen-containing compound selected from the group consisting of ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole and/or its salts, nitraminotetrazole and/or its salts, aminoguanidine nitrate, diaminoguanidine nitrate, triaminoguanidine nitrate, guanidine nitrate, dicyandiamidine nitrate, and diaminoguanidine azotetrazolate.

4. The pyrotechnic agent according to claim 1, comprising 1 to 40 wt. % of at least one high-energy additive selected from the group consisting of hexogen, octogen and nitrocellulose.

5. The pyrotechnic agent according to claim 1, comprising 1 to 15 wt. % of at least one reducing agent selected from the group consisting of aluminium, titanium, titanium hydride, boron, boron hydride, zirconium, zirconium hydride, silicon, graphite, activated charcoal, and carbon black.

6. A pyrotechnic agent according to claim 1, comprising 1 to 20 wt. % of a binder selected from the group consisting of cellulose and its derivatives, polyvinylbutyrals, polynitropolyphenylene, polynitrophenyl ether, plexigum, polyvinyl acetate and copolymers.

7. The pyrotechnic agent according to claim 1, comprising 1 to 10 wt. % of at least one combustion moderator and processing aid selected from the group consisting of ferrocene and its derivatives, acetonylacetates, salicylates, silicates, silica gels and boron nitride.

8. A thermal early-ignition agent comprising the pyrotechnic agent according to claim 1.

9. A thermal safety fuse comprising the pyrotechnic agent according to claim 1.

10. A vehicle safety system comprising the pyrotechnic agent according to claim 1.

11. A gas generator comprising the pyrotechnic agent according to claim 1.

12. A separator for battery terminals comprising the pyrotechnic agent according to claim 1.

13. The pyrotechnic agent according to claim 1, wherein the at least one azotetrazolate component and the at least one additive are not coated.

14. The pyrotechnic agent according to claim 1, wherein the at least one azotetrazolate component and the at least one additive are not coated with silicone.

15. A pyrotechnic agent consisting essentially of 20 to 50 wt. % of aminoguanidine-5,5'-azotetrazolate (AGATZ), and 50 to 80 wt. % of at least one additive selected from the group consisting of ammonium picrate, aminoguanidinium picrate, guanidinium picrate, aminoguanidinium styphnate, guanidinium styphnate, nitroguanidine, nitroaminoguanidine, nitrotriazolone, derivatives of tetrazole and/or its salts, nitraminotetrazole and/or its salts, aminoguanidine nitrate, diaminoguanidine nitrate, triaminoguanidine nitrate, guanidine nitrate, dicyandiamidine nitrate, diaminoguanidine azotetrazolate, nitrates of alkali and/or alkaline-earth metals and/or of ammonium, perchlorates of alkali and/or alkaline-earth metals and/or of ammonium, peroxides of alkali and/or alkaline-earth metals and/or of zinc, aluminium, titanium, titanium hydride, boron, boron hydride, zirconium, zirconium hydride, silicon, graphite, activated charcoal, carbon black, cellulose and/or its derivatives, polyvinylbutyrals, polynitropolyphenylene, polynitrophenyl ether, plexigum, polyvinyl acetate and copolymers, hexogen, octogen, nitrocellulose, ferrocene and/or its derivatives, acetonylacetates, salicylates, carbonates, melamine, silicates, silica gels, and boron nitride.

* * * * *